US005350012A

United States Patent [19]

Sadowski et al.

[11] Patent Number: 5,350,012

[45] Date of Patent: Sep. 27, 1994

[54] ROTARY FIN MACHINE

[75] Inventors: Kazimierz Sadowski, Ransomville; Donald Ziemendorf, Sanborn; Robert Carlo, Ransomville; Gary Kochems, North Tonawanda, all of N.Y.

[73] Assignee: Voss Manufacturing, Inc., Sanborn, N.Y.

[21] Appl. No.: 934,011

[22] Filed: Aug. 21, 1992

[51] Int. Cl.[5] ..... F28D 1/02

[52] U.S. Cl. ..... 165/152; 165/153

[58] Field of Search ..... 165/152, 153

[56] References Cited

U.S. PATENT DOCUMENTS

| | | | |
|---|---|---|---|
| 3,766,873 | 10/1973 | Narog | 113/1 C |
| 4,332,293 | 6/1982 | Hiramatsu | 165/153 |
| 4,420,039 | 12/1983 | Dubrovsky | 165/152 |
| 4,469,168 | 9/1984 | Itoh et al. | 165/152 |
| 4,693,307 | 9/1987 | Scarselletta | 165/152 |
| 4,825,941 | 5/1989 | Hoshino et al. | 165/153 |

FOREIGN PATENT DOCUMENTS

| | | | |
|---|---|---|---|
| 107190 | 6/1984 | Japan | 165/152 |
| 61892 | 3/1988 | Japan | 165/152 |
| 123996 | 5/1989 | Japan | 165/152 |

*Primary Examiner*—John Rivell
*Assistant Examiner*—L. R. Leo
*Attorney, Agent, or Firm*—Michael L. Dunn

[57] ABSTRACT

A serpentine louvered heat exchange element comprising a folded metallic strip having a length and width wherein the length is over ten times the width prior to being folded. The strip has back and forth folds with legs having substantially equal lengths defined therebetween. A plurality of the legs are provided with louvres having openings which allow the passage of fluid. Each of the folds have a fold apex with an observable preformed fold arc.

6 Claims, 3 Drawing Sheets

ROTARY FIN MACHINE

BACKGROUND OF THE INVENTION

This invention relates to heat exchanger fins and more particularly relates to such fins in folded form made from a strip of metal foil or sheet. The invention includes not only the folded fin itself but the method and apparatus for its manufacture.

Heat exchanger folded fin material is known to those skilled in the art as well as methods and apparatus for its manufacture. Such material and a method and apparatus for its manufacture are for example described in U.S. Pat. No. 3,766,873, incorporated herein by reference. U.S. Pat. No. 3,766,873 describes an apparatus wherein a strip of metallic material is fed between cutting rollers where a series of fin patterns are cut into the strip and the strip is subsequently fed to star shaped folding rollers where the strip is folded into a serpentine heat exchange fin.

Unfortunately, fins made using the apparatus, described in U.S. Pat. No. 3,766,873, are not of high enough quality for many applications. In particular, the folds are not as uniform as desired in that the arc of the fold near the fold apex and beyond, are frequently asymmetrical and distances between folds are often not as uniform as desired. Such effects are not only unaesthetic which can result in a marketing disadvantage, but cause a reduction in product quality from a performance point of view. Unequal distances between folds and asymmetric folds adversely affect the uniformity of fold height, which can in turn affect fluid flow around and through the fins and make it difficult to solder the fin to a base at each apex on a side of the fin and even if accomplished, will create a distorted fin shape.

It is known that a fairly uniform fin having a symmetrical fold arc and a fairly uniform fin height can be made using a costly and difficult to manufacture rotating fin shaping apparatus wherein the louvres are cut and formed and the bends are made simultaneously. Such a fin shaping apparatus comprises two intermeshing star shaped rollers where the surfaces represented by the legs of the points of the star have machined louvre cutting and forming blades. Such star shaped rollers having cutters on their surfaces, due to the complex and difficult machining operations required for their manufacture, are exceedingly costly, often twenty thousand dollars or more. Furthermore a separate set of such rollers is required for each change in louvre shape or fold distance.

BRIEF DESCRIPTION OF THE INVENTION

Figure 1:
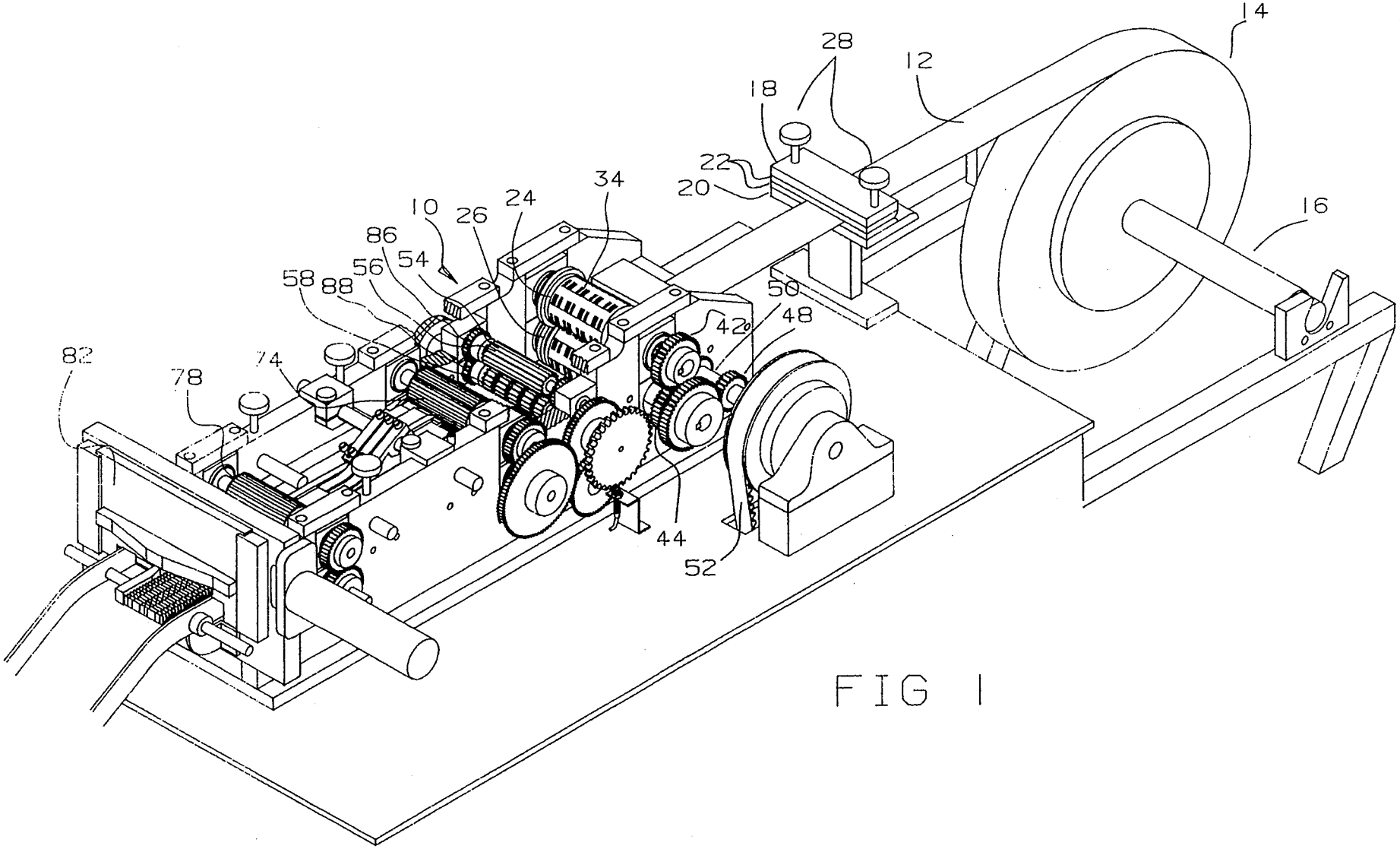
FIG. 1 is a perspective view of a preferred apparatus in accordance with the present invention.

It is therefore an object of the present invention to make a unique serpentine fin having symmetrical folds and fin height utilizing a unique method and apparatus which is much less difficult and much less costly than prior apparatus and methods used to make fairly uniform serpentine fins.

In accordance with the present invention a serpentine louvered heat exchange element is provided which comprises a folded metallic strip having a length and width wherein the length is over ten times the width prior to being folded. The strip has back and forth folds with legs having substantially equal lengths defined therebetween. A plurality of the legs are provided with louvres having openings which allow the passage of fluid. Each of the folds have a fold apex with an observable preformed fold arc. The invention also includes a method for the manufacture of a serpentine louvered heat exchange element which comprises forming louvres in a metallic strip followed by folding the metallic strip in back and forth folds. The length of the strip is at least ten times the width. The louvres are formed in a spaced series of groups of adjacent louvres. The folds are formed by initially forming arcuate depressions between the groups of louvres perpendicular to the longitudinal axis of the length followed by completing the fold in the direction of legs of the arc so that the depressions form the internal surfaces of arcuate apexes of the folds.

The invention also includes an apparatus suitable only for practicing the method of the invention. More particularly the apparatus comprises:

a) means for forming louvres in a metallic strip in a spaced series of groups of adjacent louvres, and b) means for folding the metallic strip in back and forth folds, by initially forming arcuate depressions alternating from a front and back surface of the strip so that they are between said louvre groups and perpendicular to the longitudinal axis of the length of the strip and subsequently completing the fold in the direction of legs of the arc so that the depressions form the apexes of the folds.

DETAILED DESCRIPTION OF THE INVENTION

"Serpentine" as used herein means a folded back and forth pattern, e.g. accordion shaped or shirred as in a cross sectional pattern similar to a W where all lines of the W are equal.

"Louvered" means that slits are formed in the surface of the element between folds so as to permit passage of heat transfer fluid which is usually a gas such as air but may a liquid such as water. The slits permit passage of the fluid through the metal strip from which the heat exchange element is made. The slits may be provided with canopies above, below or beside the slits to assist in directing the fluid or to improve heat transfer rate. Such canopies are usually made from a deformed portion of the strip.

The folds of the heat exchange element of the invention are unique in several respects. In particular the apexes of the folds have an observable preformed fold arc which acts to create uniform folds which are symmetrical at least in the prefolded arc area. The preformed fold arc and preferably the entire fold arc may be any arc which can be bisected to create essentially identical mirror image arc halves, e.g. hemielipses such as semicircles, parabolas, and hyperbolas. Usually, in accordance with the present invention, the radius of the fold arc is no greater than sixty times the thickness of the metallic strip from which it is formed. Commonly the fold apex arc is a circular arc having a radius of from 0.01 to 0.05 inch, where the arc is a semicircle. "Semicircle" as used herein means a half circle and is intended to include arcs slightly less than a half circle, e.g. arcs of from 160 to 180 degrees. The arc of the apex of the fold is usually such as to permit from 10 to 30 folds per inch of finished fin. Such preformed fold apex arcs are generally preformed by forming an arcuate depression in the metallic strip prior to folding which is a unique aspect of the invention.

The metallic strip from which the heat exchange element of the invention is formed may be essentially any deformable metallic substance which preferably has a high thermal conductivity. Particularly good metals for this purpose include copper, aluminum, silver and their alloys. When corrosion resistance is a problem copper and copper alloys are frequently used and when the corrosion resistance of copper and copper alloys is insufficient, gold, rare earth metals and their alloys may be used provided that sufficient deformability is maintained to permit formation of louvres and folds without fracture under reasonable processing conditions.

The metallic strip has a length to width ratio of at least ten to one and usually much greater, e.g. 100 to 1, to permit sufficient length for the formation of a plurality of folds. The thickness of the metallic strip may vary, but is usually from about 0.001 to 0.003 inch.

In accordance with the method of the invention, the louvres are formed in a metallic strip and arcuate depressions are formed in the in the strip prior to folding the strip in back and forth folds to form the serpentine louvred heat exchange element. The arcuate depressions are formed such that depressions alternate from one side of the strip to the other. A depression on one side of the strip results in a corresponding protrusion on the exact opposite side of the strip such that when a single surface of the deformed strip is observed depressions and protrusions alternate, The louvres are formed in a spaced series of groups of adjacent louvres usually by a cutting die to form parallel slits which comprise the adjacent louvres.

Preferably the louvres and arcuate depressions are formed by passing the strip between two mating forming rolls wherein the strip is cut and deformed by mating dies on the rolls to form the louvres and the strip is deformed by protrusions on each of the forming rolls which mate with arcuate depressions on its mating roll to form the arcuate depressions on the strip which become the apexes of the folds. In accordance with a preferred embodiment the arcuate protrusions on the forming rolls are formed by cylindrical pins set into arcuate depressions in the surfaces of the roll in a direction parallel to the axis of the forming roll.

The fold is made in the direction of the legs of the arcs of the preformed depression, such that a depression forms the inside of the arc of the apex of the fold and the corresponding protrusion on the opposite surface forms the outside of the arc of the apex of the fold. The arcuate depressions and folds are formed between groups of louvres essentially perpendicular to the longitudinal axis of the length of the metallic strip. The folds are made subsequent to the formation of the louvres and arcuate depressions, preferably by feeding the strip to a folding sheave comprising two mating rollers having star shaped cross sections which fold the strip back and forth so that the arcuate depressions (protrusions) become the apexes of the folds to form the serpentine heat exchange element.

The star shaped cross sections are formed by a plurality of points each having an apex and a base and being defined by side walls which meet at the apex of the points and diverge toward the base of the points. The apexes of the points are the most distant portions from the central axis of the mating roller and sidewalls of adjacent points form grooves in the surfaces of the mating rollers.

In accordance with the present invention, the sidewalls of each groove are at an angle of from 52 to 60 degrees to each other proximate the apexes of the points and the angle of the sidewall to the radius of the mating roller where the strip first enters the mating roller is from 30 to 60 percent greater than the angle of the opposing sidewall of the groove to the radius of the mating roller. It has been unexpectedly found that the somewhat larger angle at the position where the strip first enters surprisingly causes a much more uniform and symmetrical fold than was previously possible when the louvres and folds were formed in separate operations. A more uniform fold can be obtained using the above point angles than was previously possible in a dual operation even when the preformed depressions previously described are not made; although, better results are obtained when the preformed depressions are present.

Subsequent to being fed to the folding sheaves and formation of said folds, the serpentine heat exchange element is desirably compressed to tighten the folds. Such compression is usually accomplished by a hold back mechanism as the strip is passed between the forming rolls and folding rollers. The strip may, however, be cut off subsequent to formation of the serpentine element and compressed in a completely separate operation.

The apparatus for the manufacture of serpentine heat exchange elements comprises:

a) means for forming louvres in a metallic strip in a spaced series of groups of adjacent louvres, and b) means for folding the metallic strip in back and forth folds , by initially forming arcuate depressions alternating from a front and back surface of the strip so that they are between said louvre groups and perpendicular to the longitudinal axis of the length of the strip and subsequently completing the fold in the direction of legs of the arc so that the depressions form the apexes of the folds.

Examples of such means are as previously described with respect to the method and generally include the previously described mating forming rolls, the mating folding rollers and a hold back mechanism to compress the formed element. A cut off mechanism may be provided which is integral with or separate from the apparatus.

A specific preferred embodiment of the apparatus is described herein by reference to the drawings.

As shown in FIG. 1 which illustrates a perspective view of the preferred embodiment, apparatus 10 operates upon a sheet material 12 which is provided from a roll 14 held on a supporting roll shaft 16. The strip material passes between plates 18 and 20 having pads 22.

Adjusting screws 28 are provided to adjust the friction upon strip 12 thereby adjusting the tension as the strip 12 is fed to forming rolls 24 and 26.

Figure 2:
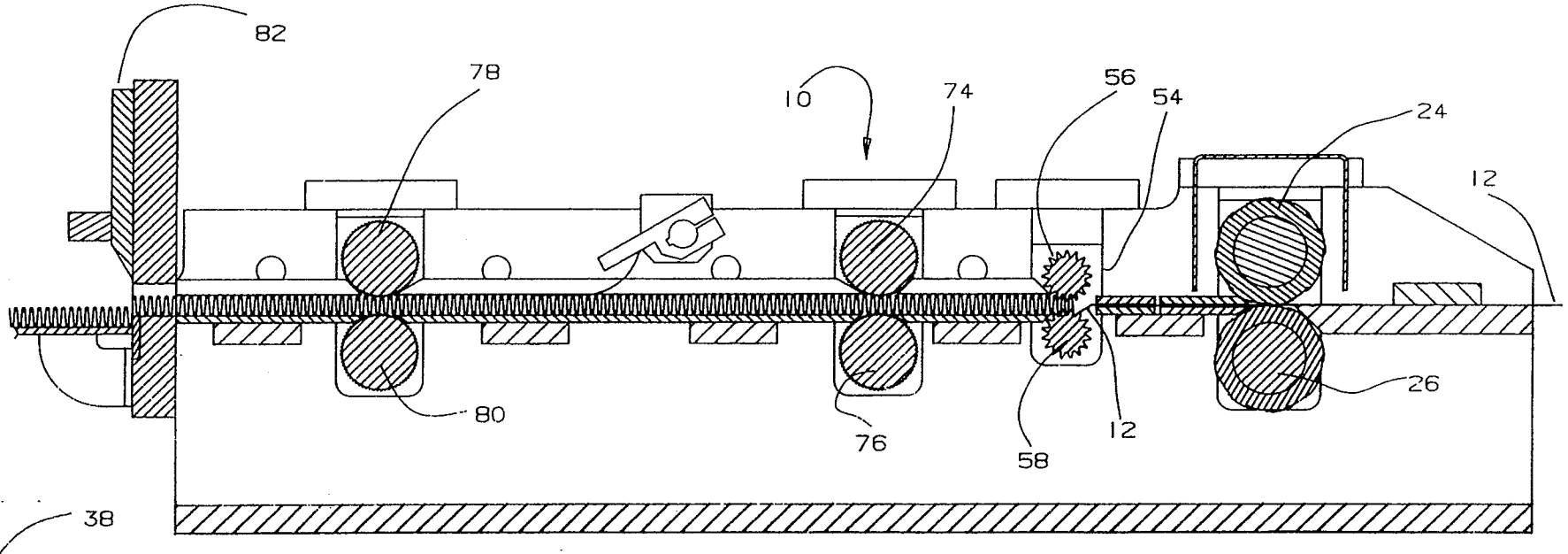
FIG. 2 is an elevational cross sectional view of the apparatus of FIG. 1.
Figure 4:
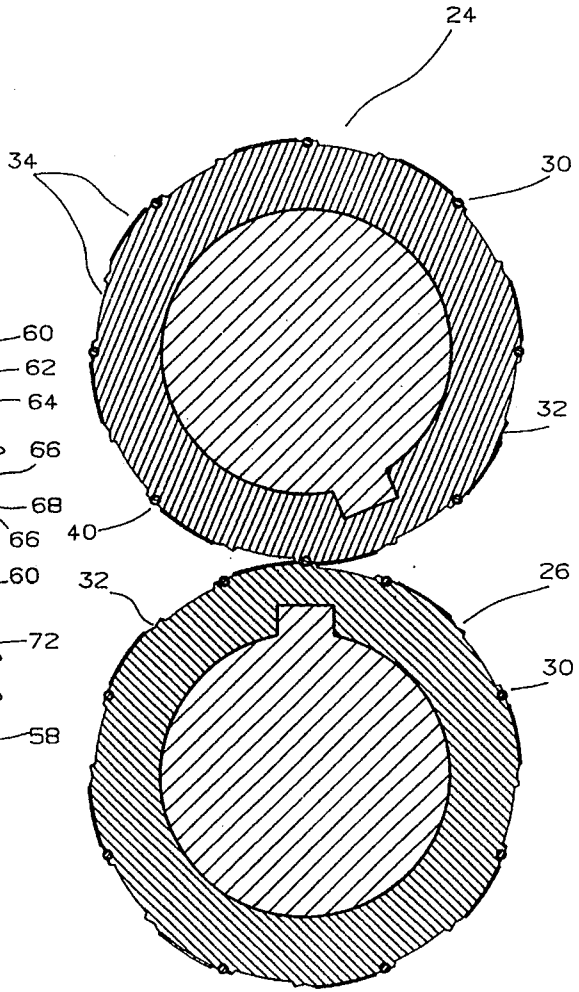
FIG. 4 is a magnified cross sectional view of the mating forming rolls, shown as part of the apparatus in FIGS. 1 and 2.
Figure 3:
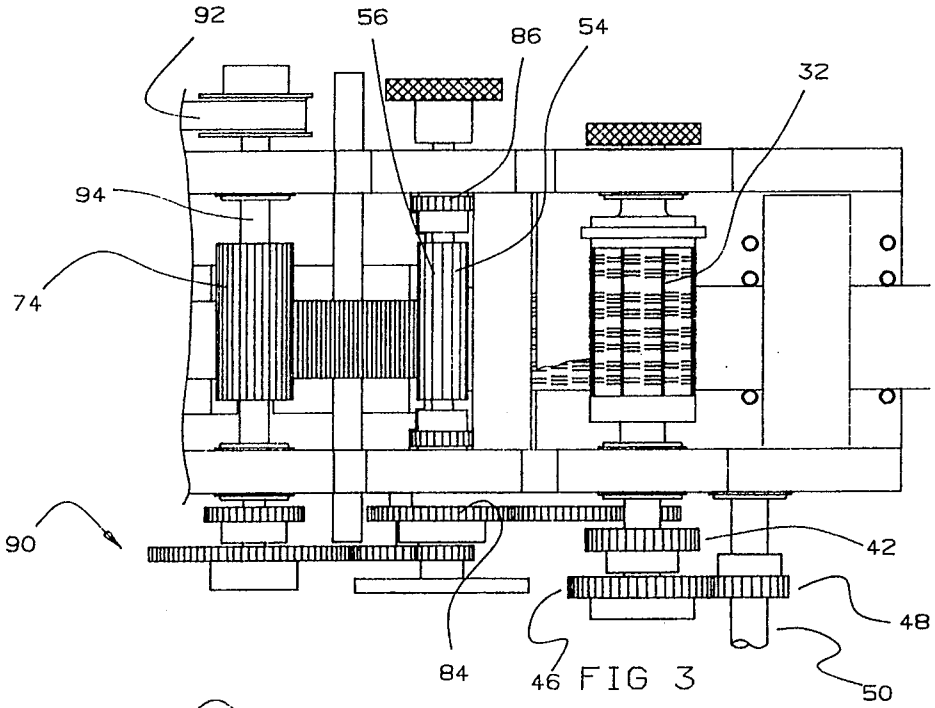
FIG. 3 is a partial top view of the apparatus of FIG. 1.
Figure 5:
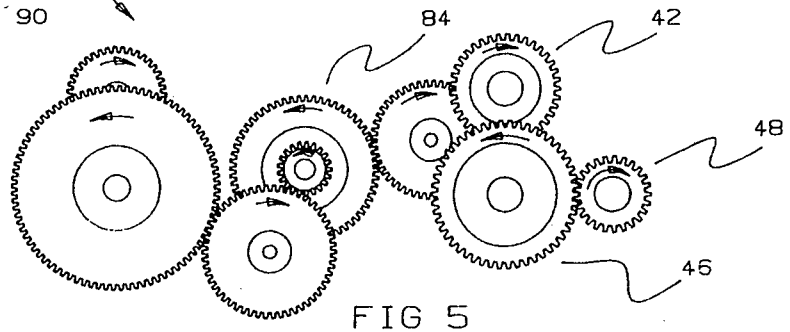
FIG. 5 shows an elevational view of the gear train used to drive the apparatus.

As best seen in perspective view FIG. 1, cross sectional view FIG. 2, top view FIG. 3 and magnified forming rolls cross sectional view FIG. 4, forming rolls 24 and 26 mate with each other and are indexed so that arcuate protrusions 30, mate with depressions 32 and louvre dies 34 similarly mate with each other. As strip 12 is pulled between rolls 24 and 26, louvres 36 are formed by dies 34, as clearly seen in FIG. 7. Similarly depressions 38 are made between protrusions 30 and depressions 32 in rolls 24 and 26. In the preferred embodiment shown, the protrusions 30 are made from horizontal pins 40 set into retaining depressions in the rolls.

Rolls 24 and 26 are driven by roll gears 42 and 44, which are in turn driven by drive gears 46 and 48. Gear 48 is attached to drive shaft 50, which is driven by belt 52 attached to a motor, not shown.

Figure 7:
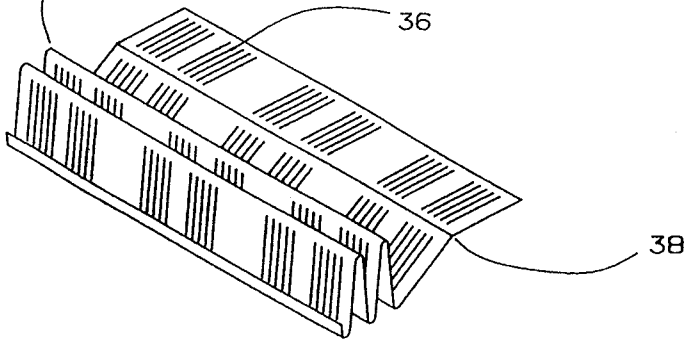
FIG. 7 shows a portion of a partially folded fin of the present invention.

After the depressions 38 and louvres 36 are formed, the strip is fed to folding sheave 54 comprising two folding rollers 56 and 58. The strip 12 is fed between the rolls 56 and 58 as best seen in FIG. 2. As rolls 56 and 58 turn, the strip is folded so that the apex of the folds occurs at depressions 38, as seen in FIG. 7. The folding rollers mate in the sense that they are indexed such that as the folds are formed, grooves 57 in the rollers are situated to accept the strip at the proper fold initiating position to form additional folds, such initial acceptance alternating between rollers 56 and 58.

Figure 6:
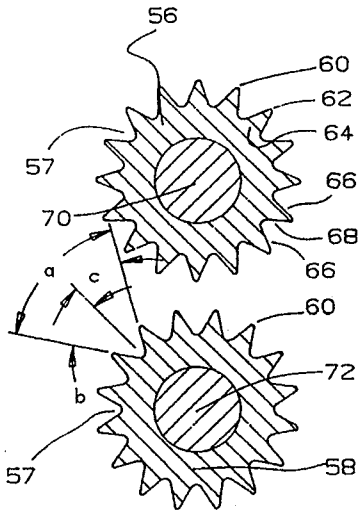
FIG. 6 shows a magnified elevational view of the folding rolls of the apparatus.

In order to accomplish the desired objectives in accordance with the present invention, the rollers 56 and 58 have a star shaped cross section, as best seen in FIGS. 2 and 6. The star shaped cross sections are formed by a plurality of points 60, each having an apex 62 and a base 64 and being defined by side walls 66 and 68 which meet at the apex 62 and diverge toward the base 64. The apexes 62 are the most distal points on rollers 56 and 58 from their central axes 70 and 72. Sidewalls 66 and 68 form the grooves 57 and in the preferred embodiment shown, the sidewalls of the grooves 57 are at an angle a to each other of from 52 to 60 degrees at a position near the apexes 60. In addition, in accordance with the preferred embodiment, the angle b of the sidewall to the radius of the mating roller 56 and 58, where the strip first enters the roller 56,58 to be folded (fold initiating position), is from 30 to 60 percent greater than the angle c of the opposing sidewall of the groove to the radius of the mating roller. It has been discovered that the angle difference, above described, adds significantly to fold uniformity and symmetry.

Rollers 56 and 58 are driven by gears 84,86 and 88 through gear train 90 to drive gear 88.

Subsequent to the formation of the folds, the fin is fed to roller pair 74,76 and on to roller pair 78,80, between which pairs, the fin is compressed. The fin is then fed by engagement of the fin with roller pairs 74,76 and 78,80 to fin cut off 82.

Roller pair 74,76 is driven by gear train 90 and roller pair 78,80 is operated by positive drive belt, which in turn is operated by shaft 94 connected to gear train 90.

Figure 8:
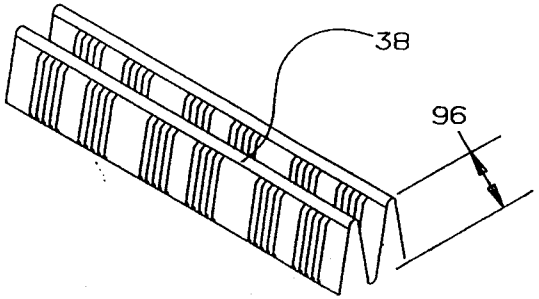
FIG. 8 shows an edge view of a finished fin of the present invention showing the uniformity of fin height and the visible performed fold apexes.

As seen in FIG. 8, the finished fin has a uniform fin height 96 and a visible preformed fold apex 38, defined by observable fold line 39.

What is claimed is:

1. A serpentine louvered heat exchange element comprising a folded metallic strip having a length and width wherein the length is over ten times the width prior to being folded, said strip having back and forth folds with legs having substantially equal lengths defined therebetween, a plurality of said legs being provided with louvres having openings which allow the passage of fluid, each of said folds having a fold apex with an observable preformed fold arc characterized by an observable fold line at a junction of the preformed fold arc with the remainder of the fold.

2. The element of claim 1 wherein the fold arc is essentially a circular arc and the radius of the arc is no greater than sixty times the thickness of the metallic strip.

3. The element of claim 1 wherein the fold arc may be bisected to form essentially identical arc halves.

4. The element of claim 3 wherein the thickness of the metallic strip is from 0.001 to 0.003 inch.

5. The element of claim 3 wherein radius of the fold apex arc is from 0.005 inch to 0.05 inch.

6. The element of claim 3 wherein the element has from 10 to 30 folds per inch of finished folded fin.

* * * * *